US005420401A

United States Patent [19]

Jacquault et al.

[11] Patent Number: 5,420,401

[45] Date of Patent: May 30, 1995

[54] MICROWAVE OVEN, IN PARTICULAR FOR RAPID HEATING TO HIGH TEMPERATURE

[75] Inventors: Patrick Jacquault, Sevres; Bernard Cerdan, Briare, both of France

[73] Assignee: Societe Prolabo, Paris, France

[21] Appl. No.: 232,482

[22] Filed: Apr. 25, 1994

[30] Foreign Application Priority Data

May 3, 1993 [FR] France ..... 93 05231

[51] Int. Cl.[6] ..... H05B 6/80

[52] U.S. Cl. ..... 219/756; 219/695; 219/746; 219/759; 219/762

[58] Field of Search ..... 219/756, 757, 759, 695, 219/696, 697, 690, 745, 746, 762, 710, 711, 714

[56] References Cited

U.S. PATENT DOCUMENTS

| | | | |
|---|---|---|---|
| 3,469,053 | 9/1969 | Levinson | 219/10.55 |
| 3,597,566 | 8/1971 | Johnson | 219/695 |
| 3,622,732 | 11/1971 | Williams | 219/695 |
| 4,019,009 | 4/1977 | Kusunoki et al. | 219/10.55 |
| 4,140,887 | 2/1979 | Sutton et al. | 219/757 |
| 4,163,140 | 7/1979 | Bardet | 219/710 |
| 4,307,277 | 12/1981 | Maeda et al. | 219/756 |
| 4,715,727 | 12/1987 | Carr | 374/122 |
| 5,026,957 | 6/1991 | Pralus | 219/756 |

FOREIGN PATENT DOCUMENTS

| | | |
|---|---|---|
| 252542 | 1/1988 | European Pat. Off. . |
| 2260918 | 9/1975 | France . |

*Primary Examiner*—Philip H. Leung

*Attorney, Agent, or Firm*—Dressler, Goldsmith, Shore & Milnamow, Ltd.

[57] ABSTRACT

A microwave oven, in particular for rapid heating to high temperature, is disclosed. A cylindrical metal housing is open at one end and has a cylindrical side wall, into which a waveguide opens, the waveguide being coupled to a microwave generator. A first outer layer of a thermally insulative, microwave-transparent material and a second inner layer thereof are provided in a coaxial configuration. A metal sleeve provided with plural coupling slots is interposed between the outer and inner layers. A muff of a microwave-absorbing material is received within a central opening of the inner layer and constitutes a heating enclosure. A metal plate fitted with an access door is provided for closing the open end of the housing. An infrared pyrometer or a thermocouple may be provided for measuring temperatures in the heating enclosure. The heating enclosure may have a vent for evacuating fumes and an orifice for injecting gases.

25 Claims, 2 Drawing Sheets

MICROWAVE OVEN, IN PARTICULAR FOR RAPID HEATING TO HIGH TEMPERATURE

FIELD OF THE INVENTION

The present invention relates to a microwave oven, in particular for performing rapid heating to high temperature on various types of substance, e.g. for performing operations of melting, baking, mineralization, calcination, heat treatment of metals, and of annealed materials, aging tests, thermal shock tests, analysis work, high temperature drying, reducing to ash for chemical tests, and more generally any endothermal chemical reaction.

BACKGROUND OF THE INVENTION

The oven of the present invention has been designed to replace laboratory ovens of the type in which heating is provided by an electrical resistance element. Such conventional ovens of the prior art suffer from various drawbacks that the present invention seeks, in particular, to avoid, and particular mention may be made of great thermal inertia, limited maximum temperature, considerable risk of the component portions of the oven being damaged, a high cost price, and high energy consumption in order to achieve high temperatures.

BRIEF SUMMARY OF THE INVENTION

The oven of the present invention comprises:

a metal housing in the form of a cylinder that is open at one of its ends and having at least one waveguide coupled to a microwave generator opening out into the cylindrical side wall thereof;

a first outer layer of a thermally insulating material that is transparent to microwaves applied against the inside surface of the cylindrical side wall of the housing and having its inside surface resting against a metal sleeve provided with a plurality of coupling slots and against the inside surface of which there presses a second inside layer of a material that is thermally insulating and transparent to microwaves and that has a central opening suitable for receiving a layer e.g. in the form of a muff that is made of a material that absorbs microwaves, that is open to the same side as said metal housing, and that constitutes the heating enclosure of the oven; together with a metal plate closing the open end of said metal housing.

In a variant embodiment of the invention, a metal sleeve provided with a plurality of coupling slots is interposed between the outer first layer and the inner second layer.

BRIEF DESCRIPTION OF THE DRAWINGS

Various other characteristic and advantages of the present invention appear on reading the following description relating to particular embodiments of ovens and made with reference to the accompanying drawings, in which.

MORE DETAILED DESCRIPTION

In the various accompanying figures, identical elements are designated by the same references.

The microwave oven of the invention firstly comprises a metal housing 10 that is cylindrical in shape being open at a front end 12 and having an opposite end wall 14 and a cylindrical side wall 16. The metal parts of the oven, and in particular the housing 10 may advantageously be made of stainless steel, or else of a refractory steel.

Figure 1:
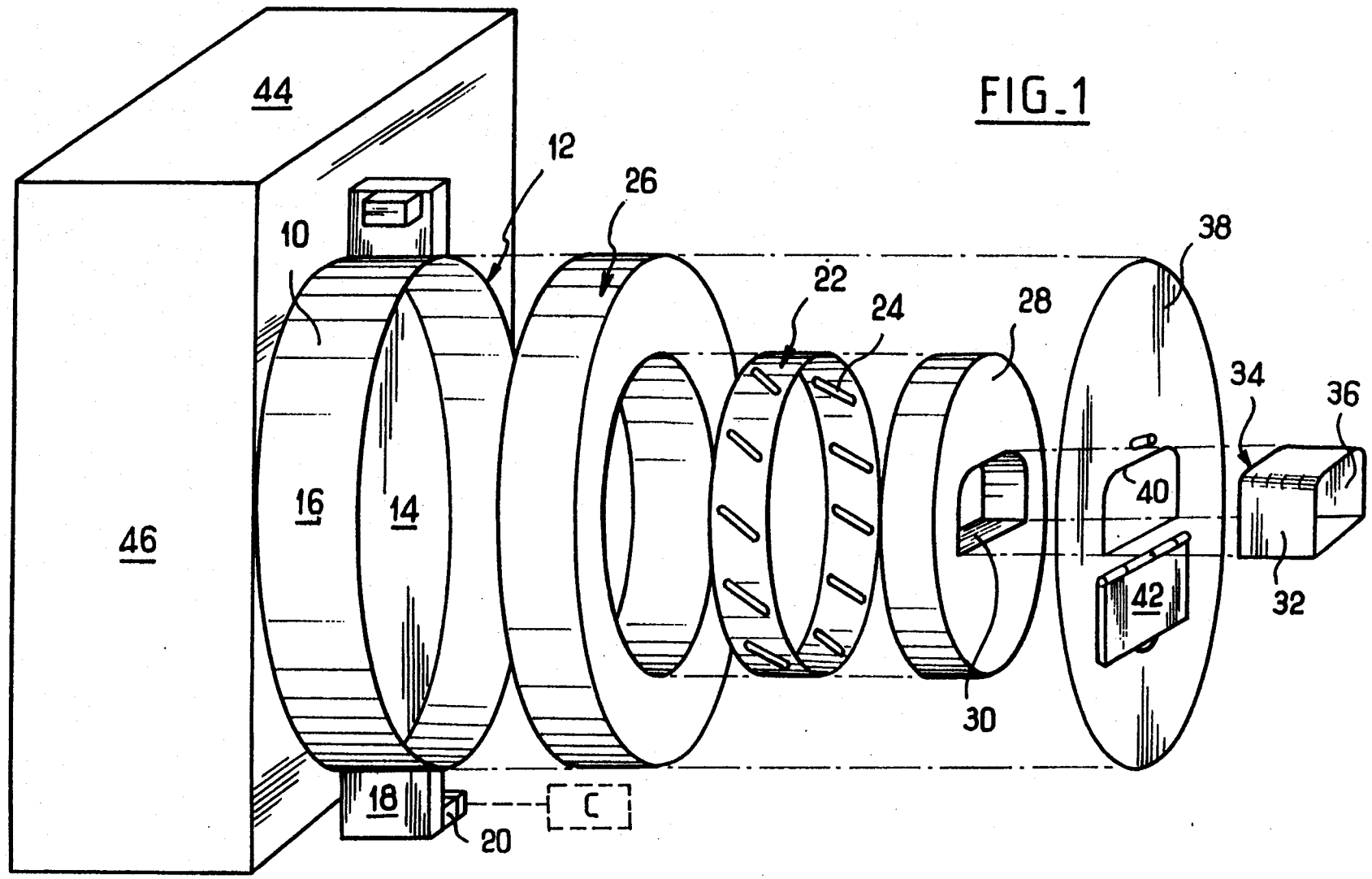
FIG. 1 is a diagrammatic exploded view of one embodiment of an oven of the invention.

The cylindrical side wall 16 of the metal housing 10 includes at least one waveguide 18 coupled to a microwave generator or magnetron 20 whose antenna opens out specifically into the waveguide 18. In the embodiment shown in FIG. 1, the cylindrical side wall 16 is fitted with two microwave generators disposed diametrically opposite each other. When the microwave oven of the present invention includes more than two microwave generators, they are then advantageously disposed around the periphery of the metal housing 10, at constant mutual angular spacing, for example.

In an advantageous variant of the invention, a metal sleeve 22 is mounted on the end wall 14 of the metal housing 10 and is itself provided with a plurality of coupling slots 24. The sleeve is advantageously made of the same metal as the housing 10 and is fixed thereto by any means suitable for withstanding the temperatures to which said parts of the microwave oven are raised. The coupling slots 24 provided through the metal sleeve 22 are advantageously distributed uniformly around the circumference of said sleeve 22, preferably at a spacing that is about half the wavelength of the guided wave. The coupling slots 24 are advantageously formed through the sleeve 22 at an inclination relative to the circumferential direction of said sleeve. In a variant embodiment of the sleeve, all of the coupling slots may have the same inclination. In another variant, some of the coupling slots may present inclination in the opposite direction relative to the circumferential direction of the sleeve.

Between the inside surface of the cylindrical side wall 16 of the housing 10 and the outside surface of the metal sleeve 22, there is interposed an outer first layer 26 of a thermally insulating material that is transparent to microwaves. Naturally, this material must be selected so as to enable it to transmit microwaves, so as to have low thermal conductivity, and so as to withstand ambient heat. In practice, it is advantageous to use a material based on inorganic fibers, in particular on fibers or a foam of a porous ceramic, e.g. fibers based on alumina or on zirconia. Such a material which may be made up of a stack of sheets of unwoven ceramic fibers, for example, and can be rested on the outside surface of the metal sleeve 22.

A second inside layer of thermally insulating material that is transparent to microwaves is pressed against the inside surface of the metal sleeve 22. This second layer is referenced 28 and is constituted by a material of the same kind as the layer 26, however it advantageously withstands higher temperatures than does the layer 26. The inside second layer 28 has a central opening 30 suitable for receiving a muff 32 made of a material that absorbs microwaves. Such a material may advantageously be selected from various types of materials based on silicon carbide, and it may be in the solid state, the scintered state, the vitrified state, and/or combined with other materials such as silicon nitride. It may also be selected from ferrites and garnets and also any composite material made of the above-mentioned materials. It is specified here that garnets are minerals satisfying the general formula $R_2R'_3(SiO_4)3$, in which R represents Al, Fe, Cr, Ti, etc. and R' represents Ca, Mg, Fe, Mn, etc. . . .

In a variant embodiment of the oven that does not include the metal sleeve 22, it will readily be understood that both layers 26 and 28 are placed in intimate contact with each other. It is clear that whereas in the variant including a metal sleeve 22 the sleeve participates in reinforcing cohesion of the oven as a whole, when the sleeve 22 is omitted, it is the strength specific to the insulating layers 26 and 28 that provides most of the mechanical strength of the oven as a whole.

It is also clear that in both variant embodiments, it is naturally possible without going beyond the ambit of the present invention to make use not only of two layers of insulating material, but of a succession comprising a larger number of layers, preferably while ensuring that the temperature performance of said layers improves on coming closer to the core of the oven.

In a variant embodiment, the muff 32 for being inserted in the central opening 30 of the insulating inside layer 28 is advantageously in the form of a cylinder that is closed at its rear end 34 and that is open at its front end 36. In practice, a muff of this type has been made in generally tubular form having a square cross-section with a side of 10 cm and having a wall thickness of about 2 mm. Naturally, various shapes may also be envisaged and depending on the intended use of the oven, it is also possible to modify considerably the dimensions and the proportions of the various portions of the oven, and in particular of the muff 32 constituting the heating enclosure of the oven.

In a variant, the muff 32 may equally well be implemented merely in the form of a layer of microwave-absorbing material that can be applied by any appropriate means to the inside surface of the central opening 30 formed in the second inside layer 28. This layer may thus be in the form merely of a coating that is applied by being painted, or sprayed, or by any other appropriate technique.

The oven of the invention also includes a metal closure plate 38 designed to close the opening 12 of the metal housing 10. Here again, the metal used for making the closure plate 38 is advantageously selected to be identical to the metal of the housing 10 and fastening should be provided by any suitable means capable of withstanding the thermal stresses to which said parts are subjected in operation.

As can be seen in the accompanying drawings, the metal closure plate 38 has an opening 40 in its center designed to enable the muff 32 to be inserted, since the muff may need to be replaced if it has become worn. Under such conditions, the metal closure plate 38 also includes a door 42 providing access to the heating enclosure. The door 42 must naturally enable the oven to be closed in a manner that is sealed against microwave leakage and it is thus advantageously fitted with an additional layer of thermally insulating material. Sealing against electromagnetic leakage may conventionally be obtained by fitting the door 42 with a quarterwave trap.

The oven of the invention is advantageously fitted with a temperature measuring system (not shown in the accompanying drawings). The temperature that needs to be obtained is naturally the temperature obtaining inside the heating enclosure, i.e. inside the muff 32. For this purpose, the temperature measuring system may be constituted, for example, by an infrared pyrometer disposed facing an opening formed through the door 42 giving access to the heating enclosure. The opening may be provided with a reinforced window designed to prevent electromagnetic leakage and also, naturally, to prevent thermal losses.

During manufacture of the oven, it is necessary to ensure good contact between the various metal parts 10, 18, 22, 38, and 42 so as to avoid electromagnetic leakage. These various metal parts are therefore assembled while taking care to ensure metallic continuity between the various metal parts, e.g. by welding, screwing, riveting, or the like.

When the oven is used at temperatures that remain significantly below 1500° C., it is also possible to implement the temperature measuring system in the form of a thermocouple that can be embedded in the microwave-absorbing material of the muff 32.

The magnetrons 20 may advantageously be controlled by a magnetic card C (as shown in dashed lines in FIG. 1 ) for a programmable control system, Which card C also includes functions of microwave power control, of shaping the signal provided by the temperature measuring apparatus, of temperature servo-control, and of communication with a programmer. It is thus easy to ensure power regulation of the microwave generators so as to implement temperature controlled cycles inside the oven enclosure, which cycles may previously be stored in the programmer.

In the various embodiments shown in the accompanying drawings, it can be seen that the metal housing 10 has an axis of symmetry which in the present case is parallel to the direction of the generator lines defining the cylinder of said housing. In the embodiment described, it can also be seen that the various main component parts of the oven, i.e. the metal housing 10, the metal sleeve 22, and the layers of insulating material 26 and 28 are organized in a coaxial configuration. Such a disposition is important for ensuring a good distribution of microwave radiation within the oven and, above all, inside the muff 32. Nevertheless, it should be specified that the circular shape of the right cross-section of the assembly of these parts is not essential. It is quite possible to envisage a coaxial configuration of all of said parts in which the right cross-section is in the form of a regular polygon.

Since the oven of the invention is designed to be used for very high temperature heating going up to 1800° C., it is advantageous to dispose the entire oven inside a support structure that also provides protection against overheating and against electromagnetic leakage, which structure is given the reference 44 in the accompanying drawings. This structure constitutes an additional housing in which the above-described oven is received and it contains additional lining material 46 made of a thermally insulating material and/or of a heat exchanger material. To this end, use may be made of rock wool or of silica wool.

Figure 3:
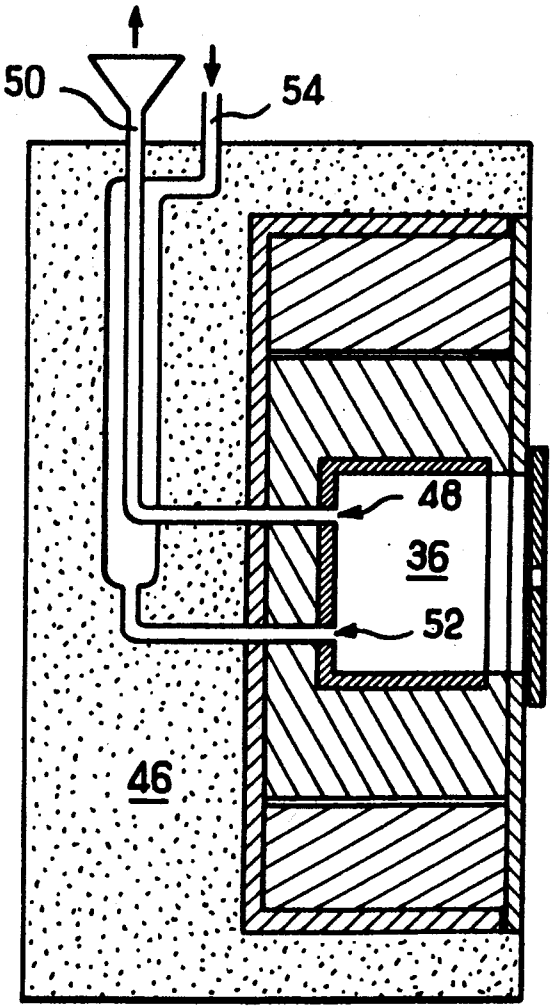
FIG. 3 is a side view in section of an oven of the invention fitted with a system for removing fumes from the heating enclosure and for injecting gas into it.
Figure 2:
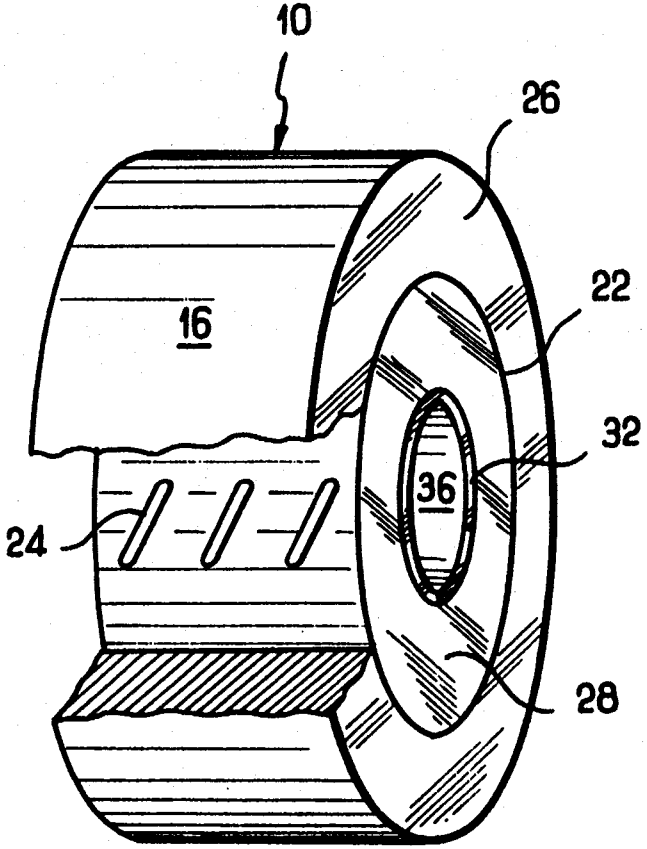
FIG. 2 is a view of the same oven in the assembled state and that is partially cutaway to show the presence of a coupling sleeve.

The oven of the present invention is designed to raise substances inserted into the muff 32 up to temperatures that are very high. While such substances are being heated, e.g. in the context of a mineralization reaction, or while preparing sulfuric ash, it is clear that fumes or other reaction gases may be given off and it must be possible for them to escape from the heating enclosure. Thus, in the embodiment shown in FIG. 3, the rear portion of the heating enclosure includes a vent 48 that is preferably located high therein and that enables fumes produced inside the oven to be exhausted by flowing through an exhaust duct 50 leading to atmospheric air.

In some cases, the oven of the invention is used for performing reactions that require the presence of a special gaseous atmosphere, e.g. an inert atmosphere of nitrogen, or on the contrary an oxidizing atmosphere that is provided by a flow of air. Under such circumstances, the heating enclosure also includes a gas injection orifice 52 which is preferably also located in the rear portion of the muff 32, but advantageously near the bottom thereof. A feed duct 54 thus serves to inject or blow a gas through said orifice 52.

Given the large temperature differences that may exist between the gas injected via the duct 54 and the fumes evacuated via the duct 50, it turns out to be advantageous in practice to couple those two ducts 50 and 54 together within a heat exchanger of the type having blades, fins, or the like so as to take advantage of the heat of the evacuated fumes for preheating the air or inert gas that is injected into the heating enclosure. Such a disposition makes it possible to increase the thermal efficiency of the oven quite considerably. Naturally, the heat exchanger structure is preferably embedded in the thermally insulating material 46 lining the support structure 44 of the oven.

Given its structure, it is clear that the microwave oven of the present invention is independent of the dielectric characteristics of the material to be heated. In other words, the microwave energy is not concentrated within the sample itself, but it is the muff 32 that concentrates the microwave energy, that heats up, and that causes the substance placed inside the heating enclosure to be heated by radiation. It can thus be said that the muff of a conventional heating oven is, to some extent, reproduced.

The main advantage of the microwave oven of the present invention lies in the fact that it does not include any heater element other than the muff 32. It therefore does not include any heating resistance element or other source of external heating that would normally be liable to deteriorate over time, particularly when high temperatures are required. In addition, as can be seen from examining the accompanying drawings, the muff of microwave-absorbing material 32 may be totally thermally insulated from the remainder of the apparatus, thus enabling electrical power to be converted into thermal power with excellent efficiency and with very low thermal inertia. Such an oven therefore makes it possible to raise temperature and to lower temperature very quickly. Thus, using two magnetrons each producing a power of 1000 watts, it is possible to raise the temperature inside the oven to 1500° C. within a period of about 15 minutes. It should be observed that in order to achieve that kind of performance using a conventional oven, it is necessary for the power supply to be of the order of 8000 watts to 10,000 watts.

Conversely, during cooling, the oven of the invention has practically no thermal inertia since 15 minutes after switching the oven off it is possible for its temperature to have dropped to below 200° C. With a conventional oven, it is necessary to wait for several hours before such cooling is achieved.

The oven of the present invention also has the major advantage of low manufacturing cost and low running cost. In the prior art, to achieve temperatures greater than 1200° C., ovens had to use refractory resistance elements that are very expensive and that are also very fragile. In contrast, as described above, when using an oven of the present invention, no fragile parts are used, no wear of a heating element can be observed, and in the event of an accident, the muff 32 is easily interchanged.

The oven of the invention also makes it possible to achieve major energy savings because of its high power conversion efficiency and because of its low thermal inertia. Inherent to its design, the oven does not radiate significantly to the outside, as is necessarily the case when use is made of heating resistance elements.

Finally, it will be observed that all of the problems usually encountered in conventional ovens due to breaks or poor contacts of the connection wires for the heater resistance elements, are necessarily absent using an oven of the invention.

We claim:

1. A microwave oven, in particular for rapid heating to high temperature, wherein the oven comprises:

a metal housing in the form of a cylinder having a cylindrical side wall with an inside surface, being open at one of its ends, and having at least one waveguide, which is coupled to a microwave generator and which opens into the cylindrical side wall;

a first outer layer made of a thermally insulating material transparent to microwaves, the first outer layer covering the inside surface of the cylindrical side wall of the metal housing and having an inside surface;

a second inner layer made of a thermally insulating material transparent to microwaves, the second, inner layer being disposed within the inside surface of the first outer layer, the second inner layer having a central opening;

a layer made of a material that absorbs microwaves, received within the central opening of the second inner layer, and constituting a heating enclosure of the oven; and a metal plate closing the open end of said metal housing;

wherein a metal sleeve provided with a plurality of coupling slots is interposed between the first outer layer and the second inner layer.

2. An oven according to claim 1, wherein the layer made of a material that absorbs microwaves is implemented in the form of a muff, which is open to the same side as is said metal housing.

3. An oven according to claim 2, wherein said muff is made of microwave-absorbing materials selected from materials based on silicon carbide in the solid state, the scintered state, the vitrified state, and/or combined with silicon nitride, ferrites, garnets, and composites of the above-specified materials.

4. An oven according to claim 1, wherein the metal housing, the metal sleeve, and the layers of insulating material are organized in a coaxial configuration.

5. An oven according to claim 1, wherein the metal housing, the metal sleeve, and the layers of insulating material have a right cross-section in the form of a regular polygon.

6. An oven according to claim 1, wherein the metal housing, the metal sleeve, and the layers of insulating material have a right cross-section that is circular in shape.

7. An oven according to claim 1, wherein the coupling slots provided in the metal sleeve are uniformly distributed around the circumference thereof.

8. An oven according to claim 7, wherein the coupling slots are spaced uniformly at a spacing close to one-half the wavelength of the guided wave.

9. An oven according to claim 1, wherein the coupling slots provided through the metal sleeve are inclined in regular or alternating manner relative to the circumferential direction of said sleeve.

10. An oven according to claim 1, wherein the layers of thermally insulating material that is transparent to microwaves are based on a ceramic.

11. An oven according to claim 10, wherein the layers of thermally insulating material that is transparent to microwaves are based on a ceramic in the form of fibers.

12. An oven according to claim 10, wherein the layers of thermally insulating material that is transparent to microwaves are based on a ceramic in the form of a porous ceramic foam.

13. An oven according to claim 1, wherein the layer constituting the heating enclosure of the oven is in the form of a cylinder that is closed at one end and open at its other front end.

14. An oven according to claim 1, wherein the metal closure plate is fitted with a door giving access to the heating enclosure, which door is sealed against microwave.

15. An oven according to claim 14, wherein the door is provided with an additional layer of thermally insulating material.

16. An oven according to claim 1, wherein the oven is fitted with a system for measuring the temperature that obtains inside the heating enclosure.

17. An oven according to claim 16, wherein the system for measuring temperature is an infrared pyrometer disposed facing an opening formed in the door giving access to the heating enclosure.

18. An oven according to claim 16 wherein the system for measuring temperature is a thermocouple embedded in the microwave-absorbing material constituting said muff.

19. An oven according to claim 1, wherein the oven is disposed within a support structure that provides protection against overheating and electromagnetic leakage, said structure having a core at which the oven is disposed, said structure being lined with a thermally insulating material.

20. An oven according to claim 1, wherein the oven is coupled to a magnetic card serving to regulate microwave power and thus the temperature inside the heating enclosure.

21. An oven according to claim 1, wherein the heating enclosure includes a vent enabling fumes produced inside the oven to be evacuated via a duct that opens out outside the oven.

22. An oven according to claim 21, wherein the duct for exhausting fumes and a duct for injecting gas are coupled together within a heat exchanger.

23. An oven according to claim 22, wherein the exhausting and injecting ducts are disposed within insulating material present in a support structure that also protects the oven.

24. An oven according to claim 1, wherein the heating enclosure includes an orifice for injecting a gas via a duct coming from outside the oven.

25. An oven according to claim 1, wherein the oven is disposed within a support structure that provides protection against overheating and electromagnetic leakage, said structure having a core at which the oven is disposed, said structure being lined with a heat exchange material.

* * * * *